US006402888B1

(12) United States Patent
Doublet et al.

(10) Patent No.: US 6,402,888 B1
(45) Date of Patent: Jun. 11, 2002

(54) SECURITY PAPER COMPRISING LOCALIZED AREAS WITH REDUCED THICKNESS AND OPACITY, AND METHOD FOR MAKING SAME

(75) Inventors: Pierre Doublet, Jouy-sur-Morin; Yves Douesneau, Le Kremlin Bicetre; Jean-Paul Menez, Verrieres le Buisson, all of (FR)

(73) Assignee: Arjo Wiggins, Issy-les-Moulineaux Cedex (FR)

( * ) Notice: Subject to any disclaimer, the term of this patent is extended or adjusted under 35 U.S.C. 154(b) by 0 days.

(21) Appl. No.: 08/862,361

(22) Filed: May 23, 1997

Related U.S. Application Data

(63) Continuation of application No. 08/513,749, filed as application No. PCT/FR94/00225 on Mar. 1, 1994, now abandoned.

(30) Foreign Application Priority Data

Mar. 2, 1993 (FR) ..... 93 02373
Sep. 28, 1993 (FR) ..... 93 11485

(51) Int. Cl.[7] ..... D21H 21/40

(52) U.S. Cl. ..... 162/140; 162/103; 162/104; 162/108; 162/110; 162/116; 162/123; 162/124; 162/125; 162/132; 162/133

(58) Field of Search ..... 162/140, 103, 162/104, 108, 110, 116, 123, 124, 125, 132, 133, 187

(56) References Cited

U.S. PATENT DOCUMENTS

| | | | | |
|---|---|---|---|---|
| 30,945 A | * 12/1860 | Karcheski | ..... | 162/140 |
| 54,835 A | 5/1866 | Jones | ..... | 162/140 |
| 987,678 A | 3/1911 | Howes | ..... | 162/140 |
| 3,366,531 A | 1/1968 | Long | ..... | 162/140 |
| 4,534,398 A | 8/1985 | Crane | ..... | 162/140 |

FOREIGN PATENT DOCUMENTS

| | | | |
|---|---|---|---|
| CA | 1123194 | 5/1982 | |
| EP | 0 091 341 | 10/1983 | |
| EP | 0 229 645 | 7/1987 | |
| EP | 319157 | 6/1989 | ..... 162/140 |
| EP | 0 388 090 | 9/1990 | |
| EP | 0 546 917 | 6/1993 | |
| EP | 0 549 384 | 6/1993 | |

* cited by examiner

*Primary Examiner*—Peter Chin
(74) *Attorney, Agent, or Firm*—Bacon & Thomas

(57) ABSTRACT

A method for making a paper sheet comprising at least one region which is thinner than the rest of the sheet. According to the method, a first paper layer (3) is formed on a wire in a first wet end of a paper-making machine, a second paper layer (5) is formed on a wire in a second wet end of the paper-making machine, one of the two paper layers has a number of localized tinner regions (8) so that the thickness ($e_2$) of said paper layers in said regions is up to 50% less than the thickness ($e_t$) of the rest of the sheet, and the two layers are joined together and dried. The resulting paper may be used in banknotes or checks.

20 Claims, 2 Drawing Sheets

SECURITY PAPER COMPRISING LOCALIZED AREAS WITH REDUCED THICKNESS AND OPACITY, AND METHOD FOR MAKING SAME

This application is a Continuation of application Ser. No. 08/513,749, filed Oct. 13, 1995, now abandoned, which is a 371 of PCT/FR94/00225, filed Mar. 1, 1994.

The invention relates to a sheet of security paper which includes localized areas with reduced thickness and opacity, particularly a paper for banknotes, or a security paper which includes important areas of reduced thickness and opacity in determined places, these areas being watermarks.

The invention preferably relates to a sheet of paper which includes at least one area having a uniform average opacity which is at least 40% lower than the opacity of the rest of the sheet.

In the present description, "paper" indicates any sheet obtained in wet fashion with the aid of a suspension of natural cellulose fibers and/or synthetic fibers which can contain various fillers and various additives currently used in paper-making.

Papers which have been made transparent are already known in the prior art. These papers are rendered transparent by, for example, chemical compositions (see in particular the French patent No. 82 05124, filed Mar. 15, 1982 by Arjomari-Prioux). These papers are rendered transparent across their entire surface and are intended for applications in engineering drawing, plan reproduction, etc.

Chemical processes for rendering papers partially transparent, that is in determined places, are also known. These processes use grease-based or mineral oil or vegetable oil-based compositions which are imprinted. However, it is difficult to print on these transparent areas using the usual current printing techniques (offset, intaglio, heliography, etc.).

It is also known to produce thickness and density differences in the paper, particularly by means of the watermark technique used to impart security to papers for banknotes, identification papers or valuable official documents. These watermarks are obtained during the manufacture of the sheet of paper by means of cylinder molds which include sunken or raised imprints or with the aid of watermark rolls which include sunken or raised patterns associated with a flat table (Foudrinier machine). An image is then obtained which, when the sheet of paper is observed by transmitted light, appears either light, if the watermark roll includes a raised pattern, or dark, if the watermark roll includes a sunken pattern. The light areas are due to the fact that the sheet thickness and the fiber density are lower than the sheet thickness and the fiber density in the areas in which the watermark roll has not made an imprint. On the contrary, the darkened areas are due to the fact that the sheet thickness and the fiber density are greater.

Such watermarks include light parts which generally have surface areas of several $mm^2$, and the variation in opacity between the light part of the watermark and the unwatermarked paper is slight. If it is desirable to print on the light areas of these watermarks, it is very difficult to coordinate the light areas with the printing, and even with very precise positioning of the watermarks, it is difficult to obtain good coordination.

European patent application No. 388 090, filed Mar. 9, 1990 by De la Rue Company, Plc., describes a security paper which includes areas of reduced opacity in predetermined, well-localized places, the areas making it possible to see by transmitted light, with the naked eye, imprints carried on the side opposite the side from which the paper is being looked at. The areas can be produced, for example, in the form of a watermark, using cylinder mold or watermark roll processes.

However, in this patent application, there is no description of how to obtain such areas from a manufacturing standpoint.

From the manufacturing standpoint, it is relatively easy to make paper which includes areas which are of reduced thickness and therefore light, obtained by means of the watermark technique, when the surface area of these areas is less than 0.4 $cm^2$. On the other hand, if it is desirable to obtain areas whose surface area is greater than 0.4 $cm^2$ by means of the watermark technique, one skilled in the art encounters technical problems.

The first problem is the following: In order to produce a watermark, one skilled in the art knows that it is possible to emboss the wire of a round cylinder with the aid of a punch. For example, if a circular light area is desired, the wire will be embossed with a circular punch. However, a light area with constant opacity is not obtained using such a process. In fact, it is noticeable that the fibers have a tendency to be deposited in greater quantity near the center of the embossed part than on the edges, and therefore the center of the watermark appears much less light than the edges. The same phenomenon occurs if a watermark roll which includes uneven raised portions is used.

A second problem which arises is that when areas of reduced thickness, which are therefore light, and which have a surface area of more than 0.4 $cm^2$, are sought, no light area is obtained.

Various means for avoiding the falsification of checks are also known. Thus, it is possible to add chemical compounds which react with acids, bases, or pencil erasers into or onto the check paper. However, new anti-falsification means are continually sought.

The European patent application filed by the Applicant on Nov. 18, 1992, and published on Jun. 30, 1993 under the number EP-A-539 384, describes a process for manufacturing a sheet of paper which includes at least one area having reduced thickness relative to the thickness of the rest of the sheet, and having a surface area of at least 0.4 $cm^2$, by disposing on an embossed or unembossed wire possibly disposed on a cylinder mold, an aqueous dispersion which contains at least cellulose fibers, by draining off the water in order to form the sheet by drying, with or without the presence of a watermark roll. Flexible pieces are used, which are associated with the watermark wire, the watermark roll or the round cylinder in such a way that the draining of the water during the formation of the sheet in the areas of the flexible pieces is reduced in relation to the draining of the water in the areas which do not include a flexible piece.

The sheet of paper obtained according to this process is such that the area having thickness is reduced to a thickness which is up to 40% lower than the thickness of the rest of the sheet. The sheet can also be such that this area has an average opacity which is up to 40% lower than the opacity of the rest of the sheet. Such a process makes it possible to obtain areas of reduced opacity. However, a reduction in the opacity of the areas is still being sought.

Moreover, the process requires a transformation of the paper-making machine, namely that the association of the flexible pieces with the watermark wire, the watermark roll, or the cylinder mold. These pieces must be fastened to the determined places and thus they require supplementary handling. Furthermore, the area has a thickness which is 30% lower than the thickness of the rest of the sheet.

Banknotes are also known which are constituted by sheets of transparent synthetic material on which a recto-verso impression is made, the impression being such that it leaves a completely transparent area. A hologram is transferred onto this transparent area. However, such plastic notes have several drawbacks. They are not very able to withstand handling and circulation since the impression can be fragile on the plastic. That is why paper notes are preferred, but at the same time why it is desired to produce the most transparent area possible. According to the process described in the document EP-A-549 384, the area obtained certainly has reduced thickness and opacity, but an area with even less opacity is sought.

Consequently, another object of the invention is to produce an area in the paper which is practically transparent or translucent, without piercing the paper in this area.

Another object is to produce an area in the paper which is practically transparent or translucent, this area being able to be printed on and/or being able to receive a hologram or any other distinctive mark or security mark.

This area must therefore be strong enough to support the transfer of a security mark.

Therefore an object of the invention is to furnish areas of reduced thickness relative to the rest of the sheet without having to use associated flexible pieces.

Another object of the invention is to furnish areas having a lower thickness reduced by much more than 40% relative to the rest of the sheet.

To this end, the invention relates to a sheet of paper which includes at least one area of reduced opacity, that is an area having a uniform average opacity at least less than about 40% relative to the opacity of the rest of the sheet, the area having a surface area of at least 0.4 $cm^2$, characterized in that the area has reduced opacity due to the reduction of its thickness relative tot he thickness of the rest of the sheet and due to the fact that it has undergone a supplementary process to make it transparent.

The sheet according to the invention can include in a part of the area of reduced opacity, a hologram, an iridescent coating, an impression in standard inks or in inks which contain colored pigments, fluorescent or luminescent pigments, or photochromic, piezooptic or piezochromic compounds.

The sheet of paper can be a one-ply or monolayer sheet, that is a sheet which includes an area whose thickness is not nil, the residual thickness being made transparent chemically.

According to another embodiment, the sheet of paper can be a two-ply or double layer sheet, that is it is constituted by a first ply or layer which includes an area whose thickness is nil, and a second ply which is rendered partially or completely transparent. In the case in which the second ply is rendered completely transparent, this ply can be obtained according to the tracing paper technique, namely from a suspension of very refined cellulose fibers, in order to obtain the transparency. In the case in which the second ply is rendered partially transparent, it is made transparent chemically in an area which comes to correspond with the nil thickness area of the first ply.

The invention also relates to a process for manufacturing a sheet of paper which includes at least one region having reduced thickness relative to the thickness of the rest of the sheet, characterized in that:

a first layer of paper is formed on a wire of a first wet end of a paper-making machine, a second layer of paper is formed on a wire of a second wet end of a paper-making machine, one of the two layers of paper having at least some local regions of reduced thickness, so that the thickness of the two layers of paper in these regions is up to 80% of the thickness of the rest of the sheet, the two layers are joined together and dried.

One or even two layers of paper can be produced without a problem, in such a way as to be very thin locally, at least one of the layers of paper in a region being locally reduced so that the thickness of the assembly of the two layers is reduced enough to obtain the proper transparency.

Even though the layers of paper are produced on separate paper wires, a sheet of paper is obtained which it is no longer possible to separate due to the rapid coupling of these layers and their being dried together. The sheet of paper is no different from a sheet of paper produced on a single wire.

The process is such that the thinner regions in the layer or layers of paper are produced by embossed regions on the mechanical wire, with the result that the deposit of fibers in these regions is reduced or completely prevented.

Preferably at least one of the layers of paper is produced by a cylinder mold machine.

Even more preferably, one of the two layers can include regions in which the thickness is nil.

The thinner regions of the paper webs are constituted in the form of a simple geometric motif, particularly in the form of flat regions which are approximately rectangular, round or elliptical, or in any other form.

The following description in reference to the drawings appended as non-limiting examples will make it possible to understand how the invention can be put into practice.

Figure 1:
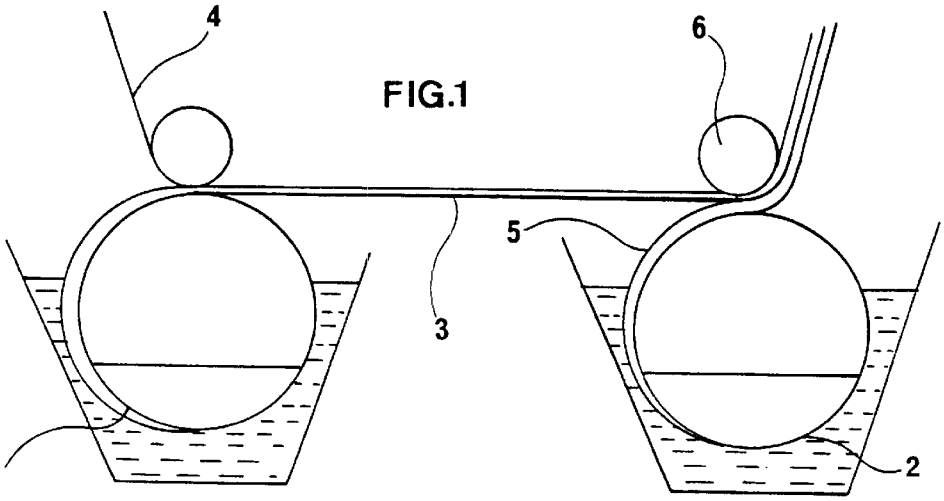
FIG. 1 shows a device which can be used to manufacture security paper according to the invention.

FIG. 1 shows a device which can be used to produce a paper according to the invention. The device essentially corresponds to the usual paper-making machines on the market, which include at least two separate wet ends. The preferred embodiment shown here is constituted by a combination of two wet ends with cylinder molds 1 and 2 of a so-called double cylinder mold paper-making machine. A first paper web 3 is produced in the wet end 1, and is directed to the second wet end 2 while being suspended below the pick-up felt 4. A second paper web 5 is produced in the second installation 2. The two paper webs are joined together at the level of the roller 6 and are then dried.

Preferably, two cylinder mold installations are used to produce the two layers of paper. But it is also possible to produce the two layers of paper in Fourdrinier installations, or to use a combination of a Fourdrinier installation and a cylinder mold installation for the production of the two layers of paper. Finally, it is possible to use only a cylinder mold, and in this case the sheet is rendered transparent in the areas of reduced thickness.

Figure 2:
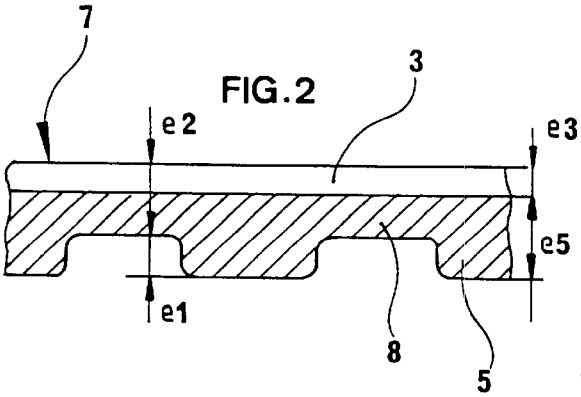
FIGS. 2, 3, 4, 5 and 6 show cross-sections of various papers produced according to the invention.
Figure 3:
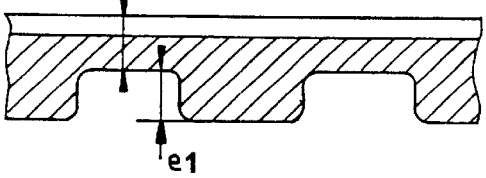

FIGS. 2 and 3 represent a paper according to the invention. This sheet 7 is formed from a first web 3 and a second web 5. The web 5 includes light watermarks 8 obtained, for example, by a raised embossing of the wire of the round cylinder 5. These light watermarks have a depth $e_1$. The total thickness $e_t$ of the sheet 7 is the sum of the thicknesses $e_3$ of the web 3 and $e_5$ of the web 5. The thickness $e_2$ of the sheet 7 facing the watermarks 8 is less than the total thickness $e_t$. In FIG. 2, $e_1=\frac{1}{2}e_t=33.3\%$ et.

In FIG. 3, $e_1=\frac{1}{2}e_t=50\%$ et.

Figure 4:
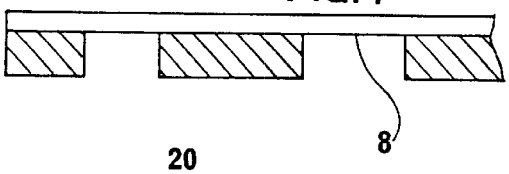

In FIG. 4, the region 8 is such that the web 5 includes a hole.

The reduction in thickness is therefore about 33% in the first case and 50% in the second case. The sheet in FIG. 3 therefore has a reduced opacity which is clearly less than the opacity of the sheet in FIG. 2, in the region 8, for a total thickness $e_t$ which is roughly equal.

By regulating the thicknesses $e_3$ and $e_5$ of the webs 3 and 5, as well as the depth $e_1$ of the watermarks 8, it is possible to obtain the desired reduced opacities and thicknesses.

Figure 5:
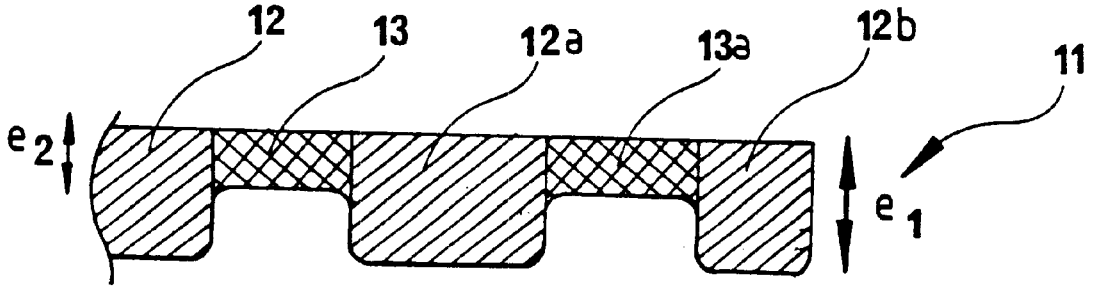

The sheet represented in FIG. 5 is produced according to the one-ply technique. This sheet is obtained by the process described in the patent application EP-A-549 384.

The sheet 11 includes areas 12, 12*a*, 12*b* with a thickness $e_1$, and areas 13, 13*a* with a non-nil thickness $e_2$. The areas 13, 13*a* have a fiber density which is clearly lower than the density of the areas 12, 12*a*, 12*b*. Each area 13, 13*a* undergoes a supplementary process to render it transparent. This process is produced chemically according to this embodiment. Preferably, the transparenting process is carried out with the aid of a transparenting composition described in Applicant's European patent application EP-91 341. The supplementary transparenting process is carried out after the sheet is dried, at the end of the machine.

This composition can be constituted by, for example:

12% of a modified ketone aldehyde condensation resin

23% of a hexamethoxymethylmelamine resin

4% ethyl alcohol

17% butyl alcohol

28% dibutyl phthalate

16% refined isopar products

This composition is applied, for example by printing with the aid of an engraved print roller, the engravings on the roller corresponding to the areas 13, 13*a* to be rendered transparent.

Figure 6:
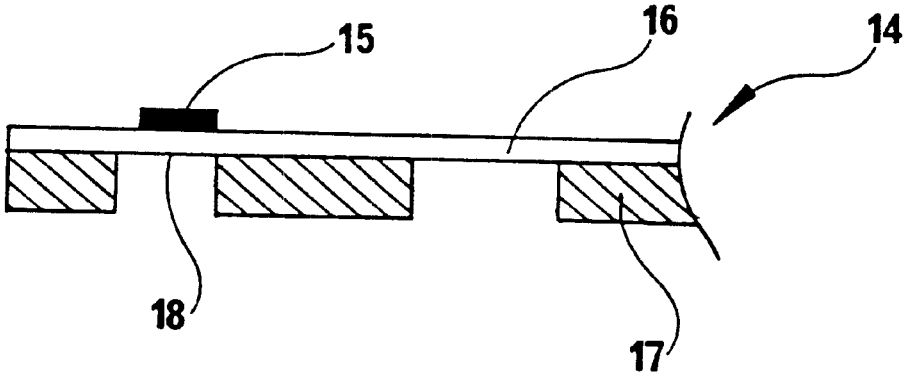

FIG. 6 represents a cross-section of a sheet 14 obtained according to the "two-ply" technique shown in FIG. 1.

The sheet 11 represented in FIG. 6 is formed by a first web 16 and a second web 17. The web 17 is such that it has areas 18 of nil thickness. The web 16 may or may not be rendered transparent in the areas situated opposite the areas 18. The web 17 can also have areas 18 with non-nil thickness which in this case are light watermarks obtained, for example, by a raised embossing of the web of the cylinder mold 5. Likewise, in this case, the web 16 may or may not be rendered transparent in areas opposite the areas 18.

The areas of nil thickness are produced by embossing the wire of the cylinder mold 5 enough so that there is no deposit of cellulose fibers at the level of the embossings.

If the two layers of paper are produced in Fourdrinier installations, the web 16 can be a tracing paper obtained by means of high-grade refining of the cellulose fibers.

Printed motifs 15 can be deposited opposite the areas 18. Layers of fluorescent pigments, layers or impressions of iridescent pigments, metallic impressions, or holograms can also be deposited. There will then be a sheet of paper which includes a transparent area of transmitted light, this area being of sizeable surface area. If a layer, for example an iridescent layer is deposited on the transparent area, and this layer only covers the transparent area partially, there will be a supplementary visual effect. Moreover, such a sheet will be very difficult to reproduce with a color photocopier since the iridescent area will not be reproduced in the copy and the transparent area will be opaque after copying.

Figure 7:
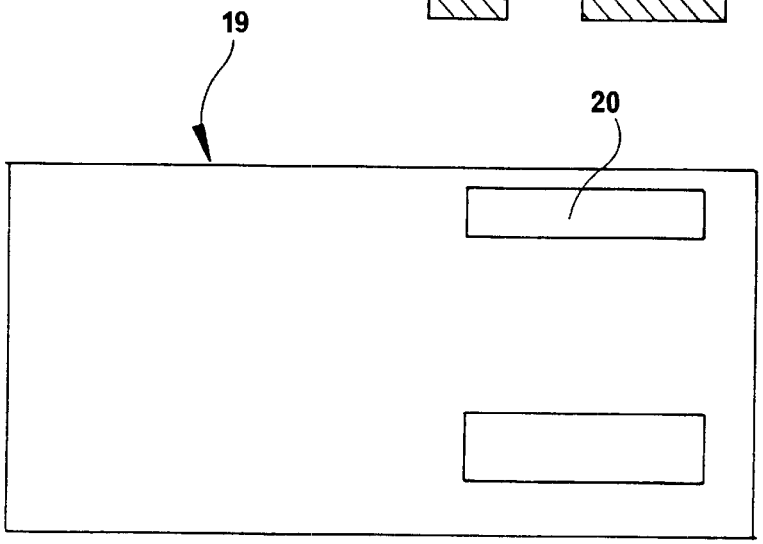
FIG. 7 shows a paper for checks obtained according to the invention.

FIG. 7 represents a security paper, preferably a paper for checks, obtained according to the process of the invention. This security paper 19 includes at least one area 20 whose thickness is less than the thickness of the rest of the sheet. Thus, if the amount of the check is written on the area 20, any infringer attempting to erase this area 20 would pierce the security paper. Preferably, the area 20 has a thickness which is less than 40% of the thickness of the rest of the sheet.

What is claimed is:

1. A process for manufacturing a sheet of paper which includes at least one region having reduced thickness relative to the thickness of the rest of the sheet, characterized in that a first layer of paper (3) is formed on a wire of a first wet end of a paper-making machine, a second layer of paper (5) is formed on a wire of a second wet end of a paper-making machine, one of the two layers of paper having at least some local regions (8) of less thickness, so that the thickness ($e_2$) of the two layers of paper in said regions is up to 80% relative to the thickness ($e_t$) of the rest of the sheet, the two layers are joined directly together and dried.

2. The process according to claim 1, characterized in that one of the two layers has local regions (8) of nil thickness.

3. The process according to claim 1, characterized in that the process is such that the regions (8) of less thickness in the layer or layer of papers are produced by raised embossed regions of the metallic wire, with the result that the deposit of fibers in these regions is reduced or totally eliminated.

4. The process according to claim 1, characterized in that at least one of the two layers of paper is produced by a cylinder mold machine.

5. The process according claim 1, characterized in that the thinner regions (8) of the paper webs are constituted in the form of a simple geometric motif.

6. The sheet obtained by means of the process according to claim 1.

7. A process according to claim 1 wherein one of the areas (8) is rendered either partially or completely transparent.

8. The process according claim 1, characterized in that the thinner regions (8) of the paper webs are constituted in the form of a simple geometric motif which is in the form of flat regions which are approximately rectangular, round, or elliptical in shape.

9. A sheet of security paper which includes at least one area of reduced opacity (3,20) of at least 0.4 $cm^2$ having a uniform reduced opacity less than the opacity of the rest of the sheet wherein the sheet is a two-ply sheet (16, 17) including one ply (17) which comprises at least one area whose thickness is nil and wherein the two plies are directly joined together.

10. The sheet according to claim 9, characterized in that the area of reduced opacity has an average reduced opacity at least 40% less than the opacity of the rest of the sheet.

11. The sheet according to claim 9, characterized in that it includes a security element (15) in part of the area of reduced opacity.

12. The sheet according to claim 9, characterized in that it is a two-ply sheet (16, 17) constituted by a first ply (17) which includes an area whose thickness is nil, and a second ply (16) rendered partially or completely transparent.

13. The sheet according to claim 12, characterized in that the second ply (16) is rendered totally transparent and is obtained according to the tracing paper technique from a suspension of extremely refined cellulose fibers.

14. The sheet according to claim 12, characterized in that the second ply (16) is rendered partially transparent by chemical means in an area which corresponds to the area (18) with nil thickness in the first ply (17).

15. A sheet as claimed in claim 9 wherein the second ply has a thickness up to 80% relative to the thickness of the rest of the sheet.

16. A sheet as claimed in claim 15 wherein the second ply has a thickness of 50 to 80% relative to the thickness of the rest of the sheet.

17. A sheet as claimed in claim 11, wherein the security element is a hologram, an iridescent layer, an impression by means of standard inks or inks which contain colored pigments, fluorescent pigments, luminescent pigments, or photochromic, piezooptic, or piezochromic compounds.

18. A sheet as claimed in claim 9, in the form of a banknote.

19. A sheet of security paper as claimed in claim 9, wherein the ply which has a portion whose thickness is nil contains no security tread.

20. A sheet of security paper as claimed in claim 9, wherein the area of reduced opacity has a constant reduced opacity.

* * * * *